United States Patent [19]

Olson et al.

[11] Patent Number: 4,627,761

[45] Date of Patent: Dec. 9, 1986

[54] RETAINER

[75] Inventors: Gene E. Olson, Kenosha; Norbert J. Kot, Milwaukee, both of Wis.

[73] Assignee: Snap-on Tools Corporation, Kenosha, Wis.

[21] Appl. No.: 655,234

[22] Filed: Sep. 28, 1984

[51] Int. Cl.[4] ..... B25G 3/26; B25B 23/16

[52] U.S. Cl. ..... 403/324; 403/378; 403/408.1; 81/177.85; 411/356; 411/517; 411/530

[58] Field of Search ..... 403/378, 379, 324, 108, 403/408.1; 411/352, 353, 356, 357, 363–365, 517, 530; 81/177.85, 124.6

[56] References Cited

U.S. PATENT DOCUMENTS

| | | | |
|---|---|---|---|
| 1,265,341 | 5/1918 | Keller . | |
| 1,730,278 | 10/1929 | Laing | 411/353 |
| 1,740,094 | 12/1929 | Huff | 411/353 |
| 2,110,397 | 3/1938 | Kangas . | |
| 2,304,038 | 12/1942 | Thompson | 403/324 |
| 2,589,482 | 3/1952 | Downey . | |
| 2,675,256 | 4/1954 | Cornell . | |
| 2,974,992 | 3/1961 | Oates | 403/379 X |
| 3,024,031 | 3/1962 | Davidson | 403/379 X |
| 3,446,523 | 5/1969 | Little . | |
| 3,549,160 | 12/1970 | Etzkorn | 403/379 X |
| 3,679,244 | 7/1972 | Reddy | 411/530 X |
| 3,980,805 | 9/1976 | Lipari | 403/378 X |
| 4,135,835 | 1/1979 | Kitchen et al. | 403/108 X |
| 4,183,691 | 1/1980 | Van Melle | 403/324 |
| 4,222,462 | 9/1980 | Ottestad | 403/324 |
| 4,266,453 | 5/1981 | Farley | 81/177.85 |
| 4,304,500 | 12/1981 | Faulk | 403/108 |
| 4,464,090 | 8/1984 | Duran | 411/517 X |
| 4,477,096 | 10/1984 | Wallace et al. | 403/108 |

*Primary Examiner*—Cornelius J. Husar
*Assistant Examiner*—Todd G. Williams
*Attorney, Agent, or Firm*—Emrich & Dithmar

[57] ABSTRACT

A flexible retainer for coupling an inner polygonal stud and an outer tubular member includes an elongated arm from which a pair of spaced fingers transversely extend. The outer tubular member includes a polygonal bore into which the inner stud is inserted in a telescoping manner. The inner stud includes a transverse hole which when aligned with diametrically positioned lateral apertures in the outer tubular member forms a generally transverse channel in the telescoping member combination. With the arm of the retainer positioned around a portion of the periphery of the outer tubular member, each of the fingers positioned thereon may be inserted within a respective lateral aperture of the outer tubular member so as to extend into the transverse hole of the stud in securely coupling the two telescoping members. The retainer is preferably comprised of a one-piece, molded, elastomeric material and is particularly adapted for use with a circular socket arrangement although it may be used with telescoping members having virtually any cross-sectional shape. Gripping means are provided at one end of the elongated arm to facilitate removal of the retainer from the telescoping member combination, which members may then be separated.

11 Claims, 7 Drawing Figures

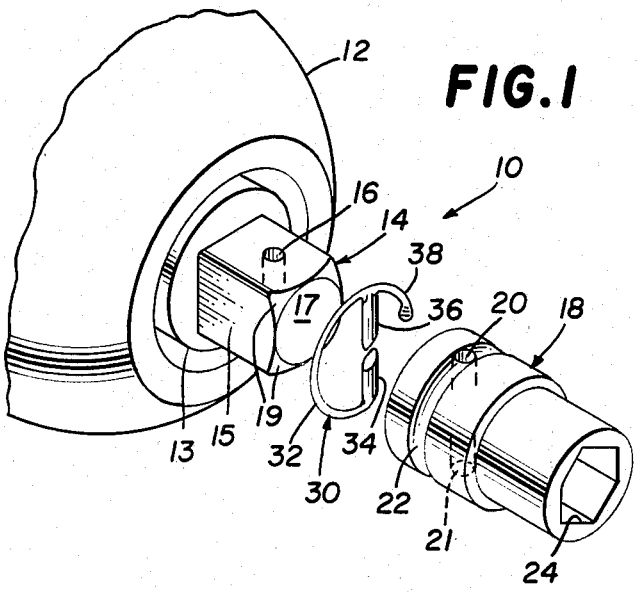
FIG. 1
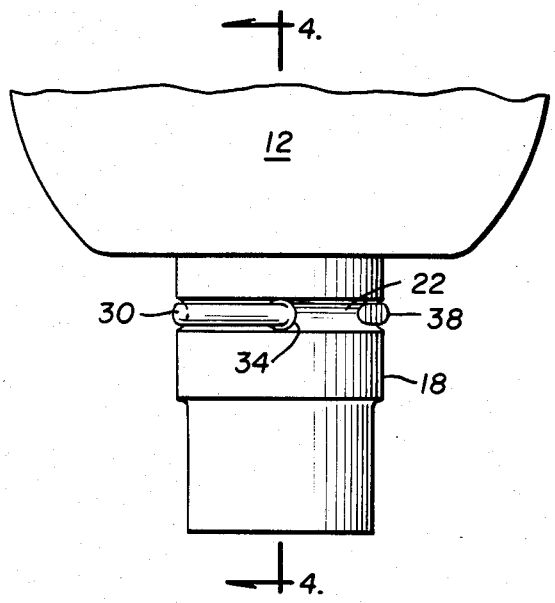
FIG. 2
FIG. 3
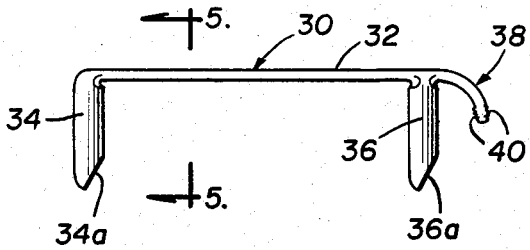
FIG. 4
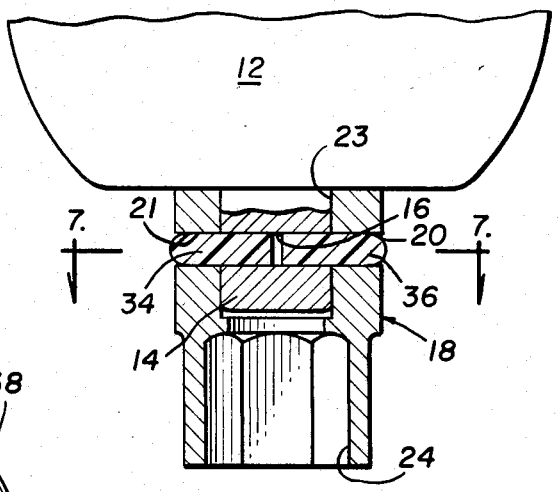
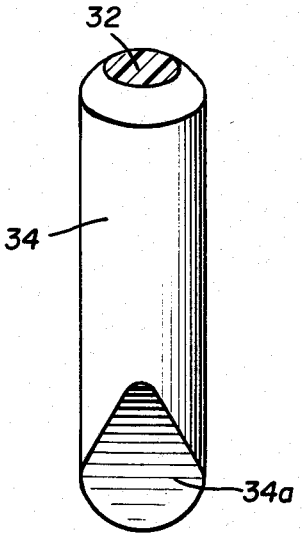
FIG. 5
FIG. 6
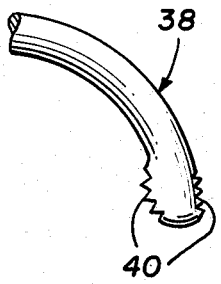
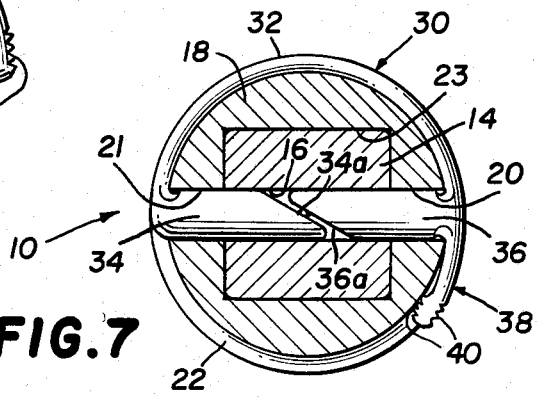
FIG. 7

RETAINER

BACKGROUND OF THE INVENTION

This invention relates generally to the coupling of telescoping members and is more particularly directed to an arrangement for securely mounting a socket on the stud of a driver.

Linear arrangements of telescoping members are used in a variety of applications. One such application involves the coupling between a stud and a socket having respective outer and inner cross-sectional configurations which are complementary and provide for engagement therebetween. This arrangement is common to many power driven tools wherein the power driven polygonal (typically square) stud of the tool is inserted within and fastened to a socket. While the complementary nature of the respective inner and outer surfaces of the socket and drive stud ensures rotational coupling between the telescoping components, an additional element such as a retainer is needed to prevent longitudinal displacement between the telescoping members and to maintain them in a coupled arrangement.

This type of retainer includes an elongated portion adapted for insertion within aligned apertures in the socket and the drive stud. Prior art retainers have been generally difficult to manipulate, frequently requiring two hands and sometimes even an additional tool to install and remove. In addition, the coupling between the telescoping members may be lacking in terms of reliability and safety. This limitation is frequently encountered in the case of the aforementioned power driven tools wherein the high speed rotation and vibratory action of the tool results in the accidental dislodgment of the retainer and substantially increases the possibility of damage to the tool and injury to the operator. Finally, prior art retainers are generally intended and designed for use with telescoping component arrangements of predetermined size requiring either a standardized socket size or a plurality of retainers of varying size to accommodate sockets having a range of sizes. The requirement for standard tool sizes limits the versatility of the power drive tool, while the need for several variously sized retainers is not only inconvenient, but also increases the cost of the tool.

The present invention is intended to overcome the aforementioned limitations of the prior art by providing a unitary, flexible, retainer for securely and reliably coupling telescoping members in an inexpensive, easily manipulated, and highly adaptable coupling arrangement.

SUMMARY OF THE INVENTION

Accordingly, it is an object of the present invention to provide secure coupling between telescoping members.

It is another object of the present invention to facilitate the coupling and decoupling of a telescoping socket-stud combination.

Yet another object of the present invention is to provide an inexpensive, easily manipulated, reliable and secure means for coupling telescoping members in preventing relative displacement therebetween.

A further object of the present invention is to provide socket retention means for securely positioning a socket on a stud wherein the socket may be inserted and removed without the aid of tools using only one hand.

In summary, there is provided a retainer for interconnecting a polygonal stud in the polygonal bore of an outer tubular member, the outer tubular member having diametrically opposed first and second apertures and the stud having a transverse hole therethrough. The retainer is of one-piece construction and comprises an elongated flexible arm and first and second fingers positioned in spaced relation along the arm and extending laterally therefrom, the first finger being positionable through the first aperture and into the bore and the second finger being positionable through the second aperture and into the bore.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

FIG. 1 is an exploded perspective view of a telescoping assembly including a retainer in accordance with the present invention, the nose of a power tool also being shown;

FIG. 2 is a lateral view of the telescoping assembly of FIG. 1 wherein the two telescoping members are aligned and coupled by means of the retainer;

FIG. 3 is a lateral view of the retainer shown in FIGS. 1 and 2;

FIG. 4 is a sectional view of the telescoping assembly with a retainer of FIG. 2 taken along line 4—4 therein;

FIG. 5 is a sectional view of the retainer of FIG. 3 taken along line 5—5 therein;

FIG. 6 shows the details of the gripper tab located on one end of the retainer; and FIG. 7 is a sectional view of the telescoping assembly with a retainer shown in FIG. 4 taken along line 7—7 therein.

DETAILED DESCRIPTION OF THE PREFERRED EMBODIMENT

Referring to FIG. 1, there is shown an exploded perspective view of a telescoping assembly 10 incorporating a retainer 30 in accordance with the present invention. The telescoping assembly 10 includes a power tool 12 having a drive shaft 13 from which extends a stud 14. The stud 14 includes a linear bore 16 extending therethrough and is defined by a plurality of lateral, adjoining flats 15. Typically, four flats 15 form the lateral portions of the stud 14 so that it possesses a generally square cross section. The free end 17 of the stud 14 is provided with chamfered, or beveled, corners 19 to facilitate its lengthwise insertion within a socket 18 as described below. The drive shaft 13 and the stud 14 are typically machined from a single piece of metal and thus form a unitary structure. The drive shaft 13 is coupled to a drive mechanism such as a pneumatic drive system (not shown) for effecting the rotation thereof in the power tool 12.

The socket includes first and second end openings 23, 24. The first end opening 23 of the socket 18, as shown in FIGS. 4 and 7, is adapted to receive the stud 14 in tight-fitting relation. Thus, the first end opening 23 in the socket 18 is defined by four inner surfaces thereof forming a generally square opening on the end of the socket 18. The second end opening 24 of the socket 18 is adapted to engage a nut or a bolt head, for the manipulation thereof by the telescoping assembly 10 under the control of the power tool 12.

The socket 18 shown has a generally circular cross section. The lateral surface of the socket 18 includes first and second apertures 20, 21 diametrically aligned relative to the longitudinal axis of the socket 18. If the socket 18 does not possess a circular cross section, the first and second lateral apertures 20, 21 therein would be positioned in facing, opposed surfaces thereof such that a line passing through the first and second apertures would intersect the cross sectional center line of the socket 18. The outer surface of the socket 18 further includes a peripheral groove 22 around the circumference thereof. The first and second lateral apertures 20, 21 in the socket 18 are positioned within the peripheral groove 22. Each of the first and second lateral apertures 20, 21 in the socket 18 extends from the outer periphery thereof into the first end opening 23 of the socket 18.

Referring to FIG. 3, there is shown a lateral view of a retainer 30 for use with the telescoping assembly 10 in accordance with the present invention. The retainer 30 is similarly shown in FIG. 1 wherein it is configured so as to conform with the outer cross sectional shape of the socket 18. Thus, in a preferred embodiment of the present invention, the retainer 30 is shaped so as to generally conform with the outer peripheral cross section of the socket upon which it is positioned as described below.

The retainer 30 includes first and second fingers 34, 36 extending from an elongated, flexible arm 32. At one end of the flexible arm 32 is located a gripper tab 38 which includes a serrated portion 40, shown in greater detail in FIG. 6. The gripper tab 38 facilitates the removal of the retainer 30 from the socket 18 as described below. The first and second fingers 34, 36 are positioned along the flexible arm 32 in spaced relation as determined by the displacement between the first and second lateral apertures 20, 21 of the socket 18. Thus, the length of the flexible arm 32 between the first and second fingers 34, 36 is no greater than the distance on the outer surface of the socket 18 between the first and second lateral apertures 20, 21 therein. However, the length of the flexible arm 32 between the first and second fingers 34, 36 is not required to precisely match the distance between the first and second lateral apertures 20, 21 within the socket 18. The retainer 30 of the present invention is thus capable of securely coupling sockets having a wide range of cross sectional sizes as well as virtually any cross sectional shape.

In a preferred embodiment, the free, or distal, ends 34*a*, 36*a* of the first and second fingers 34, 36 are chamfered, or beveled, as shown in the various figures. FIG. 5, which is a sectional view of the retainer 30 as shown in FIG. 3 taken along line 5—5 therein, shows the chamfered end 34*a* of the first finger 34 in greater detail. The chamfered end portions 34*a*, 36*a* of the first and second fingers 34 and 36 facilitate their insertion within and removal from a respective lateral aperture 20, 21 within the socket 18. By chamfering the respective ends thereof, the first and second fingers 34, 36 may be provided with increased length for enhanced retention of the retainer 30 when positioned upon the telescoping assembly 10. The relative position and orientation of the chamfered ends of the first and second fingers 34, 36 when inserted in the telescoping assembly 10 is shown in FIG. 7. From this figure it can be seen that with one of the fingers inserted within a lateral aperture of the socket 18 and extending into the bore 16 of the stud 14, the chamfered end portion of the other finger will facilitate its insertion within the other lateral aperture of the socket 18. This arrangement thus facilitates the insertion of the retainer 30 within the telescoping assembly 10 while allowing for maximum usable finger length and enhanced engagement with the telescoping assembly 10.

Once properly positioned upon the telescoping assembly 10, the elongated, flexible arm 32 of the retainer 30 is positioned within the peripheral groove 22 in a lateral portion of the socket 18. To remove the retainer 30 therefrom, the serrated portion 40 of the retainer 30 is grasped and pulled outward from the socket 18. This causes the second finger 36 of the retainer 30 to be withdrawn from the bore 16 of the stud 14 as well as from the first lateral aperture 20 of the socket 18. The chamfered end 36*a* of the second finger 36 facilitates its withdrawal therefrom. Removal of the retainer 30 from the peripheral groove 22 in the socket 18 along the length thereof causes the first finger 34 to be withdrawn from the bore 16 of the stud 14 as well as from the second lateral aperture 21 of the socket 18. It is in this manner that the retainer 30 is removed from engagement with the telescoping assembly 10.

As previously stated, the length of the arm 32 between the fingers 34 and 36 is less than half the circumference of the groove 22. Thus, the arm 32 must be stretched somewhat in order to place the fingers 34 and 36 in position. The stretching and resultant tendency toward an unbiased condition improve the ability of the retainer 30 to be firmly held in position. Also, the length of each of the fingers 34 and 36 is more than half the length of the bore 16, so that if the bore 16 was longer, at least a portion of each finger would still reside in such bore. That the ends are chamfered means that each of the fingers can be longer than half the length of the bore and yet fit within such bore.

There has thus been shown a retainer for coupling inner and outer telescoping members which includes an elongated arm from which a pair of spaced engaging fingers extend and upon one end of which is provided serrated gripper means for facilitating the removal of the device from the telescoping assembly. Although described herein as connecting a socket to a stud, the retainer of the present invention could be used to connect any tubular member with a polygonal bore to a polygonal stud. The retainer is preferably comprised of a unitary, elastomeric material and is particularly adapted for connecting a tubular socket to a drive shaft such as in power driven impact tools.

We claim:

1. A retainer for interconnecting a polygonal stud in the polygonal bore of an outer tubular member, the outer tubular member having diametrically opposed first and second apertures, the stud having a transverse hole therethrough, said retainer being of one-piece construction and comprising an elongated flexible arm having first and second ends and first and second fingers of substantially the same length formed integrally with said arm in spaced relation along said arm and extending laterally from said arm near opposite ends thereof, said first finger being positionable through the first aperture and into one end of said hole, said second finger being positionable through the second aperture and into the other end of said hole, with free ends of said first and second fingers being located adjacent to one another in said hole of said stud in substantially abutting relationship when so positioned, the length of said arm between said first and second fingers being no more than half the circumference of the outer tubular member whereby said arm is positioned in tight fitting relation around the periphery of the outer tubular member when said fingers are located within respective apertures of the outer tubular member.

2. The retainer of claim 1, being composed of elastomeric material.

3. The retainer of claim 1, wherein the free ends of said first and second fingers are chamfered, and the chamfered free ends overlap one another.

4. The retainer of claim 1, wherein the length of said arm between said first and second fingers is less than half the circumference of the outer tubular member.

5. The retainer of claim 1, wherein the cross-sectional area of said arm between said first and second fingers is less than the cross-sectional area of said fingers.

6. In a telescoping assembly wherein a polygonal stud is inserted within a polygonal bore of an outer tubular member, said stud having a transverse hole therein and said outer tubular member having first and second aligned radial apertues therein so as to form a channel through said assembly when aligned with said transverse hole, a one-piece retainer comprising an elongated flexible arm conforming generally along the length thereof with the outer surface of the tubular member between the first and second apertures therein, said arm having first and second ends and first and second fingers of substantially the same length formed integrally with said arm and located in spaced relation on said arm near opposite ends thereof for insertion within the first and second apertures, respectively, of the tubular member and within respective end portions of the transverse hole within the stud with free ends of said first and second fingers positioned adjacent to one another for securely coupling the stud and the tubular member, and gripper means on said first end of said arm for facilitating the removal of said retainer from the telescoping assembly, the length of said arm between said first and second fingers being less than half the circumference of the outer tubular member so that said arm must be stretched in order to insert said fingers into said tubular members, and said arm is positioned in tight fitting relation around the periphery of the outer tubular member when said fingers are inserted within respective apertures of the outer tubular member.

7. The retainer of claim 6, wherein the free ends of said first and second fingers overlap when thus positioned.

8. The retainer of claim 6, wherein said first and second fingers respectively include chamfered free ends to facilitate their insertion within the removal from the respective apertures in the outer tubular member and wherein said chamfered free ends are positioned in overlapping relationship within the transverse hole of said stud when thus inserted.

9. The retainer of claim 6 wherein the outer tubular member and the stud include a plurality of paired, facing surfaces positioned in abutting contact with one another.

10. A retainer for interconnecting a polygonal stud in the polygonal bore of an outer tubular member, the outer tubular member having diametrically opposed first and second apertures, the stud having a transverse hole therethrough, said retainer being of one-piece construction and comprising an elongated flexible arm and first and second fingers of substantially the same length in spaced relation along said arm and extending laterally from said arm near opposite ends thereof, said first finger being positionable through the first aperture and into one end of said hole, said second finger being positionable through the second aperture and into other end of said hole, with free ends of said first and second fingers being located adjacent to one another in said hole of said stud in substantially abutting relationship when so positioned, and gripper means on said arm for facilitating the removal of said retainer from the coupled stud and tubular member, said gripper means being located at one end of said arm, said first finger being located on the other end of said arm, and said second finger being located on said arm intermediate the ends thereof.

11. The retainer of claim 10, wherein said gripper means is a serrated tab on one end of said arm.

* * * * *